US005766044A

United States Patent [19]

Norden

[11] Patent Number: 5,766,044

[45] Date of Patent: Jun. 16, 1998

[54] MULTIPLE-POST CONNECTORS AND METHOD OF MAKING MULTIPLE-POST CONNECTORS

[75] Inventor: Alexander R. Norden, Boca Raton, Fla.

[73] Assignee: Eugene A. Norden, New York, N.Y.

[21] Appl. No.: 441,019

[22] Filed: May 15, 1995

[51] Int. Cl.[6] ..... H01R 11/09; H01R 43/16

[52] U.S. Cl. ..... 439/798; 29/34 R; 29/874; 408/1 R

[58] Field of Search ..... 29/874, 884, 34 R; 439/797, 798; 408/1 R

[56] References Cited

U.S. PATENT DOCUMENTS

| | | | |
|---|---|---|---|
| 3,930,522 | 1/1976 | Turner | 138/111 |
| 4,693,644 | 9/1987 | Takahashi | 408/204 |
| 5,531,617 | 7/1996 | Marks | 439/798 |
| 5,555,620 | 9/1996 | Kies | 29/874 |

*Primary Examiner*—P. W. Echols

[57] ABSTRACT

Connectors having multiple posts upstanding from a common cross-connection bus are produced by a method that includes the steps of making an extrusion that encompasses the end projection of the connector including the bus and the posts, and then using hollow end-milling cutters to form the posts.

18 Claims, 2 Drawing Sheets

FIG. 1
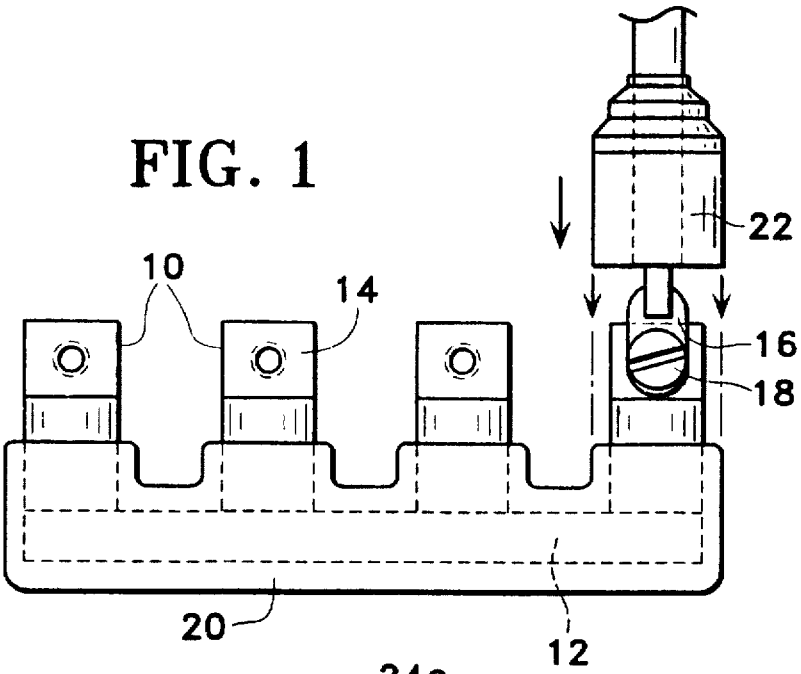
FIG. 2
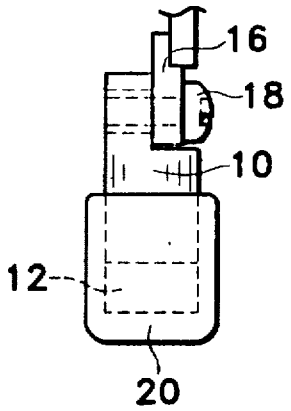
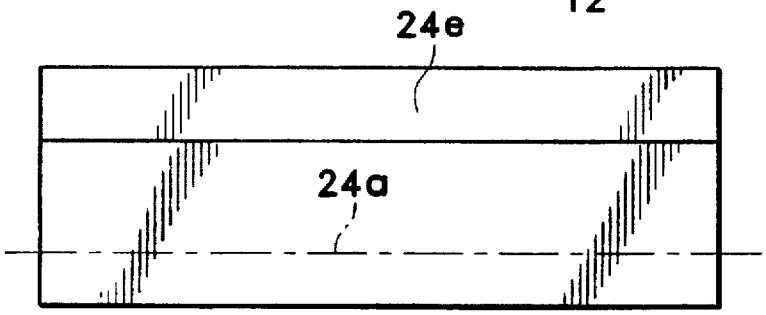
FIG. 3
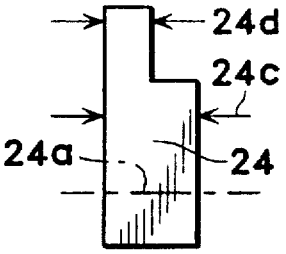
FIG. 4
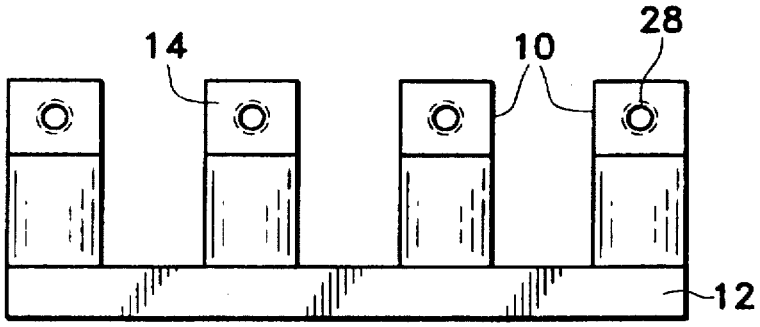
FIG. 5
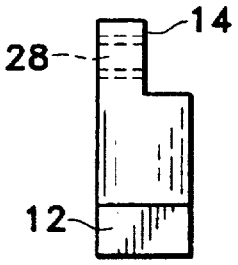
FIG. 6
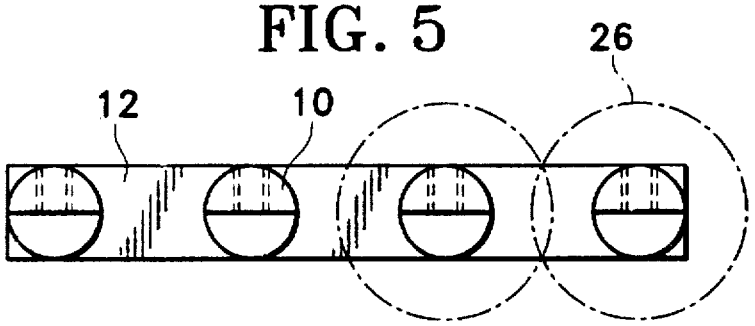
FIG. 7

MULTIPLE-POST CONNECTORS AND METHOD OF MAKING MULTIPLE-POST CONNECTORS

The present invention relates to a particular form of electrical connector, which comprises a row of terminal posts upstanding from a common connection bus. More particularly, the invention relates to a method of making such connectors.

BACKGROUND OF THE INVENTION

Connectors of that form have been produced for many years using castings as the starting material, finished by secondary operations. This practice follows the common wisdom that production of such terminals should start with a casting that embodies the basic structure of the connector, in this instance the shaped posts upstanding from the connection bus. Using the casting as the starting material avoids machining operations to produce the basic shape. It is commonly understood and accepted that resort to machining for producing such a basic shape entails costly operations that are obviated by the casting step. Undoubtedly, this explains the routine use of castings heretofore, in making the electrical connectors here involved.

Separately, neutral bars have long been produced by preparing a simple bar by extrusion, then drilling wire-receiving holes and cross-drilling and tapping holes for wire-retaining screws. Other connection devices have been produced by a process that starts with an extrusion, followed by secondary finishing steps.

SUMMARY OF THE INVENTION

An object of this invention resides in providing a new and economical method of making electrical connectors of the type having a common connection bus and a row of terminal posts upstanding from the bus.

A further object of the invention resides in producing terminals having a row of terminal posts upstanding from a common connection bus, without resort to casting. When a casting is used as the basic structural shape, the finished electrical connection device may have occluded bubbles that impair conductivity and that may seriously weaken the structure of the connector, in random instances.

Accordingly, an object of the invention resides in providing a novel method of producing electrical terminals of the type having a row of posts upstanding from a common connection bus, by a method that is economical and which at least largely precludes occluded bubbles.

Electrical connectors are produced pursuant to this invention by a process that includes forming the basic shape replacing the casting by the steps of initially preparing an extrusion whose end view encompasses both the cross-section of the connection bus and a volume of metal having an outline encompassing the side view of the electrical posts, then forming the upstanding posts by means of a hollow end-mill directed toward the portion of the extrusion that embodies the connection bus. The electrical connector is completed by the usual drilling and tapping operations performed heretofore on the casting. However, the end result is that the costs of the casting mold and of the operation of producing the casting are replaced but not augmented in the novel method, and the flaw of occasional bubbles in castings is essentially eliminated.

The nature of the invention and its advantages will be more fully appreciated from the following detailed description, to be considered together with the accompanying drawings.

BRIEF DESCRIPTION OF THE DRAWINGS

In the drawings:

FIG. 1 is a side view of one form of an electrical connector of the type here involved, showing a circuit connection;

FIG. 2 is an end view of the connector of FIG. 1;

FIGS. 3 and 4 are a side view and an end view of an extrusion used in producing the connector of FIGS. 1 and 2 by the novel method;

FIGS. 5, 6 and 7 are a side view, an end view, and a top plan view of the extrusion of FIGS. 3 and 4 following all of those metal working operations needed to produce the connector of FIGS. 1 and 2;

Referring now to the drawings, particularly to FIGS. 1 and 2, an electrical connector is shown of the type that may be made either by the procedure involving a casting or in accordance with the invention. In FIGS. 1 and 2, a connector is shown having four terminal posts 10 upstanding from a connection bus 12. Each post 10 has a cylindrical lower portion and an upper portion having a flat area 14 against which the lug 16 of a circuit connector is secured by a fastening screw 18. Bus 12 and a portion of each post is covered by a coating of insulation 20. As shown, the circuit connection includes an insulated wire in addition to a lug 16, and a boot 22 of insulation is slidable along the insulated wire and into abutment with the coating of insulation 20 on the connector. Boot 22 has a cylindrical cavity that fits snugly around the cylindrical lower portion of post 10. In this way, some protection is provided for the connection of the wire to the connector, against attack by the environment in which the connector is used. FIGS. 3 and 4 show a ductile metal extrusion used in the present novel method for producing the connector of FIGS. 1 and 2.

Figure 8:
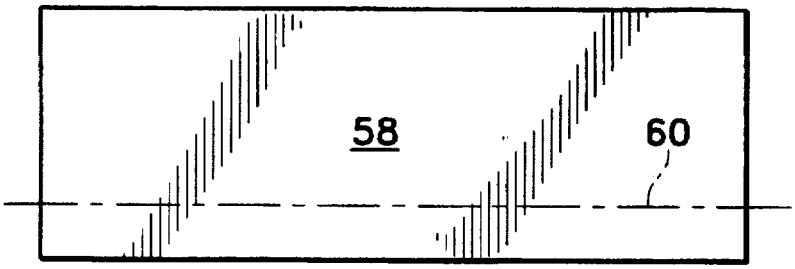
FIGS. 8 and 9 are side and end views, respectively, of an extrusion used in producing another form of electrical connector pursuant to this invention.

The outline of extrusion 24 encompasses the end projection of the common bus connection 12 below the broken line **24*a* and the cross-section of the extrusion also encompasses the outline of the terminal posts 10 (FIGS. 1 and 2) as viewed from one end of the connector. Thus, above the material that is to constitute the connection bus 12, the cross-section of the extrusion has a width 24*c* that is at least equal to the diameter of posts 10; and the outline of the extrusion includes a top portion 24*d* that is reduced (compared with portion 24*c*) so as to constitute a preformed lateral surface 24*e* that ultimately is to provide flat areas 14 of the terminal posts 10**.

A hollow cylindrical end-milling cutter C (FIG. 12) acts on extrusion 24 from the top downward to remove bulk metal of the extrusion so as to leave one post 10 after another upstanding from bus 12. This may be performed in a series of operations, or a pair of hollow end-milling cutters may be used to form the first and third terminal posts in one operation and the pair of hollow end-milling cutters may be used in another operation to form the second and fourth terminal posts 10. As seen in FIG. 7, broken lines 26 show the outer circles of the cuts made by the end(s) of the end-milling cutter(s). In the example shown, posts 10 are spaced apart by little more than the wall thickness of the cutters; with that proportion, the cutters form a flat upper surface of common connection bus 12 between the posts 10.

The basic structure of the electrical connector is completed by the two-step process of making the extrusion followed by operation of the hollow end-mill cutter to form the posts. The electrical connector is completed by drilling and tapping holes 28, one per post or (in other forms) two per post. Insulation 20 is applied by a conventional dip-and-cure treatment.

Figure 12:
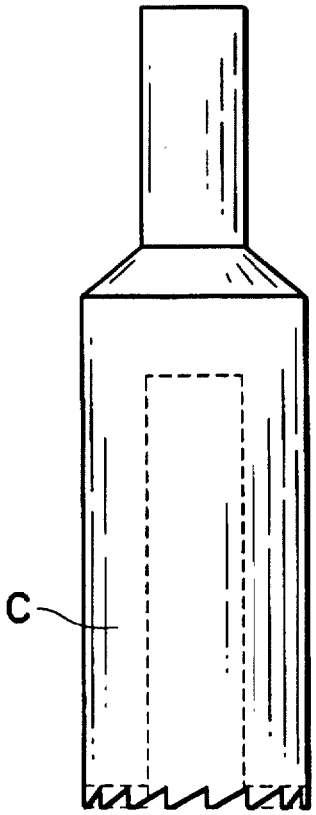
FIG. 12 is a side view of a hollow end-milling cutter used in forming terminal posts.

As indicated in FIG. 12 and by broken lines 26, the wall of the hollow end-milling cutter is quite thick. If the wall of the cutter were thin or if the posts were spaced apart wider than they are in FIGS. 5 and 7, the areas of broken-line circles 26 would not extend over the whole top surface of the common connector bus 12. Then, after the posts have been formed by the cutting operation, vestigial projections upstanding from the common connection bus would remain as tall as the posts. For many reasons, the hollow end-milling cutters should be proportioned to preclude any such vestigial projections.

If the thickness 24*c* of the extrusion were less than the diameter of the posts, or if the hollow end-milling cutters were used carelessly, the posts would have lateral flat surfaces. While not fatally defective, such flats would constitute passages along the posts when the boots are in place. The atmosphere in which the connector is used might then penetrate to the circuit connection at the top of each post via that passage, with potentially damaging effect. Attention should be given to proper use of the hollow end-milling cutters, to avoid lateral flat surfaces on the posts.

Figure 10:
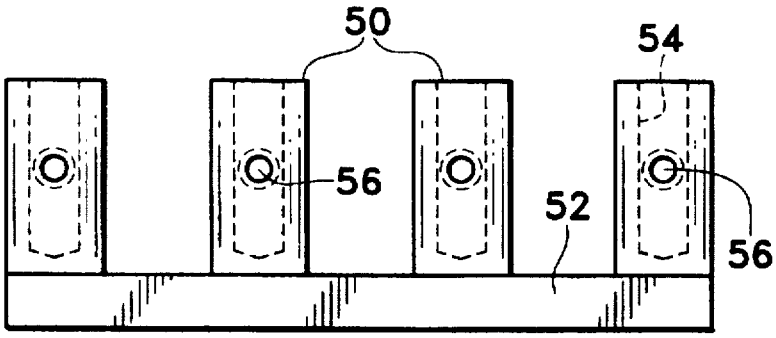
FIGS. 10 and 11 are side and end view, respectively, of the metal portion of another electrical connector made by the novel method of the invention.
Figure 11:
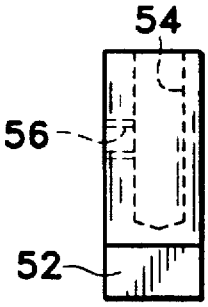

Virtually the same novel procedure is followed in producing electrical connectors of the form shown in FIGS. 10 and 11. In that connector there are four terminal posts 50 upstanding from common connection bus 52. Each post 50 has a vertical wire-receiving hole 54 and a horizontal threaded hole 56 for a wire-retaining screw (not shown). Tapped hole 56 is in a wall see (FIG. 11) of the post that is thicker than the opposite wall; for this effect the vertical hole is drilled off-center in its post.

Figure 9:
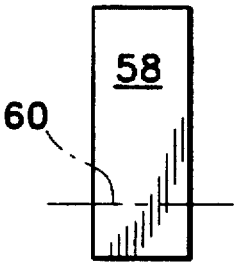

An extrusion 58 is shown in FIGS. 8 and 9; the cross-section of the extrusion includes material below broken line 60 (FIGS. 8 and 9) which is to constitute the common connector bus 52. Above line 60 is a part of the extrusion whose end view encompasses terminal posts 50 as seen from one end of the connector.

As described above in relation to FIGS. 3–7, a hollow end mill (FIG. 12) is used to cut extrusion 58 so as to form cylindrical posts 50 and to develop the top flat surface of common connection bus 52.

Connectors of the type involved here, produced by the novel method, are superior to the same type of connectors as produced heretofore, in that occluded bubbles and other flaws occasioned in casting are obviated. It is striking that the novel method enables production of the superior connectors in a manner which not only avoids prohibitive expense, but which actually is economical. The dominating consideration is that the connectors produced by the novel method are superior to those produced by the method used heretofore, involving the use of castings, and that the method which yields superior connectors does not entail prohibitive manufacturing costs.

I claim:

1. The method of making electrical connectors that have opposite ends and a lengthwise-extending cross-connection bus and multiple terminal posts upstanding integrally from the cross-connection bus, said bus and posts being essentially free, consistently, of occluded voids, the method including the preparatory step of making an elongated extrusion of ductile metal having a cross-sectional profile encompassing the terminal posts and the cross-sectional bus of the connector as viewed from either end of the connector and, with one or more hollow end-milling cutters directed transverse to the extrusion, removing portions of the extrusion as necessary to leave multiple terminal posts upstanding integrally from a cross-connection bus, at least the lower portions of the posts being cylindrical.

2. The method in claim 1, wherein the wall thickness of the hollow end-milling cutter is sufficient to preclude vestigial portions of the extrusion projection upward from the cross-connection bus between the posts.

3. The method as in claim 1, wherein said terminal posts have coplanar axes and have respective contact areas in a plane parallel to the plane containing the axes of said terminal posts, and wherein the extrusion produced in the first step of the method has a planar area containing such contact areas.

4. The method as in claim 1, further including the step of forming at least one tapped hole in each post transverse thereto for screws to secure connections to said posts.

5. An electrical connector having opposite ends and having a lengthwise-extending cross-connection bus and multiple terminal posts upstanding integrally from the cross-connection bus, the bus and posts of such connectors being essentially free, consistently, of occluded voids, made by the process including the preparatory step of making an elongated extrusion of ductile metal having a cross-sectional profile encompassing the terminal posts and the cross-connection bus of a connector as viewed from either end of the connector and, with one or more hollow-end milling cutters, removing portions of the extrusion as necessary, to leave multiple terminal posts upstanding integrally from a cross-connection bus, at least the lower portions of the posts being cylindrical.

6. The electrical connector as in claim 5, wherein each of said posts has at least one transverse tapped hole therein for screws for securing connections to the posts.

7. The method of making an electrical connector that has opposite ends and a lengthwise-extending cross-connection bus and multiple terminal posts upstanding from one side of said cross-connection bus, the method including the steps of performing machining operations on an elongated extrusion of ductile metal having a cross-sectional profile encompassing said cross-connection bus and said terminal posts as viewed from either end of the electrical connector, said machining operations including the steps of forming each terminal post with a hollow end mill directed transverse to said extrusion, and drilling and tapping at least one transverse hole in each post, for screws for fastening connections to the posts.

8. A method of making an electrical connector comprising the steps of machining an elongated generally rectangular cross-sectioned extruded bar stock of conductive metal by hollow milling the bar stock transversely from one side of the bar stock to a depth spaced from the opposite side of the bar stock to form posts projecting from the unmilled side of the bar stock, removing any excess metal between the posts to the same depth as said posts, and forming and tapping holes in said posts normal to the longitudinal axes of the posts to enable electrical conductors to be clamped to the posts.

9. A method as set forth in claim 8, including the step of axially longitudinally drilling a hole in said posts to form a projecting barrel, and then drilling and tapping a hole through the wall of the barrel whereby a conductor may be clamped inside the barrel.

10. A method as set forth in claim 9, including the step of drilling the hole in the post eccentrically of the post to form a barrel, and then drilling and tapping the hole through the wall of the barrel at the point of largest wall thickness.

11. A method as set forth in claim 8, wherein each post is form ed by a hollow mill.

12. A method as set forth in claim 11, wherein the interior diameter of the hollow mill is substantially the same as the width of the bar stock.

13. A method as set forth in claim 8, wherein said bar stock includes a recessed surface which forms a flat on the projecting end of each post to which a conductor is clamped.

14. A method as set forth in claim 13, including the step of forming the flat as an extruded surface.

15. A method as set forth in claim 14, including the step of forming the flat by extrusion whereby the flat extends axially of the post when milled for about one third or more of the axial project ion of the post.

16. A method as set forth in claim 15, including the step of forming one or more fastener holes in said flat to enable the lug of a conductor to be secured thereto in compression.

17. A method of making an electrical connector having multiple spaced-apart posts upstanding from a cross-connection bus, including the steps of machining an elongated ductile metal extrusion by means of a hollow end mill driven only partway through the extrusion transversely for producing each of said posts and for providing a remaining portion of the extrusion constituting the cross-connection bus of the electrical connector.

18. A method of making an electrical connector as in claim 17, wherein said hollow end mill machines about and between said posts an essentially flat upper surface, on said remaining portion of the extrusion.

* * * * *